United States Patent [19]

Iwai

[11] 4,019,258

[45] Apr. 26, 1977

[54] DEVICE FOR ATTACHING ROLLERS TO A CARRIAGE ADAPTED TO MOVE ALONG A RAIL

[75] Inventor: Tadayoshi Iwai, Tokyo, Japan

[73] Assignee: Mutoh Industry Ltd., Tokyo, Japan

[22] Filed: Feb. 13, 1976

[21] Appl. No.: 658,015

Related U.S. Application Data

[63] Continuation of Ser. No. 538,779, Jan. 6, 1975, abandoned.

[52] U.S. Cl. ..... 33/79 R

[51] Int. Cl.[2] ..... B43I 13/02

[58] Field of Search ..... 33/76 R, 79 R, 80; 105/30

[56] References Cited

UNITED STATES PATENTS

| | | | |
|---|---|---|---|
| 189,152 | 4/1877 | Thomas et al. | 105/30 |
| 502,112 | 7/1893 | Bramwell | 33/76 R |
| 1,042,743 | 10/1912 | Wuest | 33/76 R |
| 1,149,120 | 8/1915 | Fortune | 33/79 R |
| 2,627,323 | 2/1953 | Larson | 33/76 R |
| 2,874,474 | 2/1959 | Beebe et al. | 33/76 R |
| 3,729,827 | 5/1973 | Perminov | 33/79 R |

*Primary Examiner*—Richard E. Aegerter
*Assistant Examiner*—John W. Shepperd
*Attorney, Agent, or Firm*—Wenderoth, Lind & Ponack

[57] ABSTRACT

A device for rotatably attaching rollers to a carriage in such a manner that the peripheries of the rollers are maintained in engagement with rail surfaces arranged longitudinally of a rail along which the carriage is adapted to move in sliding movement. The device comprises presser means provided in the carriage and comprising members each associated with one of the rollers, each member being formed therein with a inclined surface and adapted to move in linear motion. At least one of the rollers is supported for movement toward and away from the associated rail surface at right angles thereto. The device further comprises resilient means adapted to resiliently urge the pressing means to bring the inclined surfaces of the presser means into resilient engagement with roller support means whereby the rollers can be maintained in resilient engagement with the respective rail surfaces.

3 Claims, 11 Drawing Figures

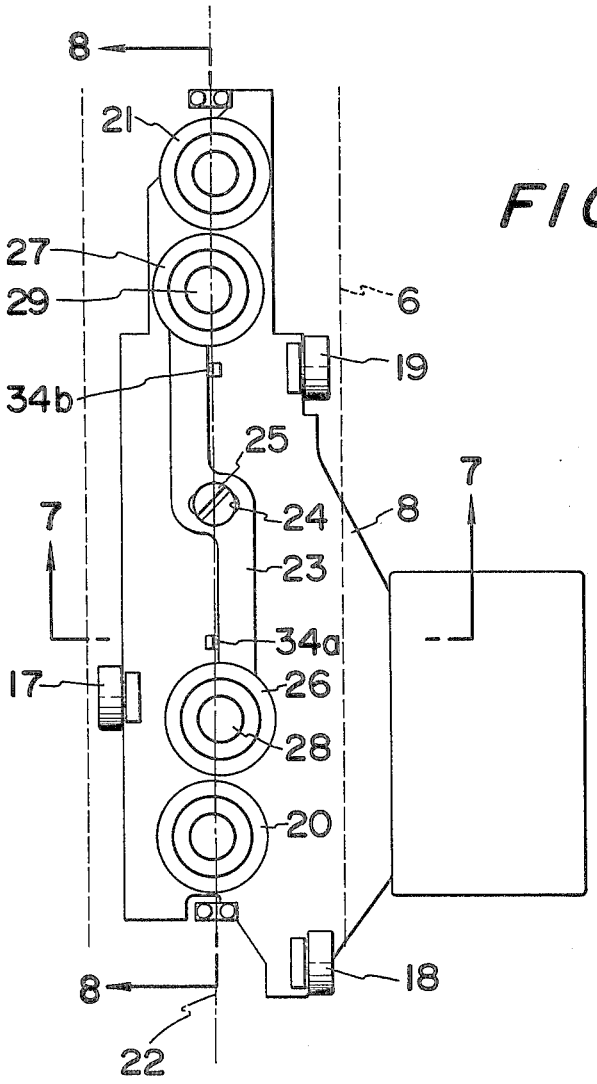
FIG. 6
FIG. 7
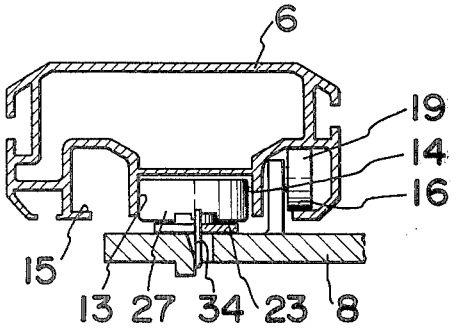

DEVICE FOR ATTACHING ROLLERS TO A CARRIAGE ADAPTED TO MOVE ALONG A RAIL

This is a continuation of application Ser. No. 538,779 filed Jan. 6, 1975, and now abandoned.

BACKGROUND OF THE INVENTION

This invention relates to a device for attaching rollers to a carriage adapted to move in sliding motion along a rail in a drawing apparatus, plotting machine or like apparatus of the rail type.

In mounting a carriage for sliding motion on a rail in a drawing apparatus or a plotting machine of the rail type, the usual practice is to bring a plurality of rollers each rotatably attached to the carriage through a shaft into engagement with at least a pair of rail surfaces disposed parallel to each other and extending along the longitudinal axis of the rail, and the movement of the carriage along the rail is controlled by the rail surfaces.

In the aforementioned construction of the prior art, when a force oriented longitudinally of the rail is exerted on the carriage, the rollers rotate on the respective rail surfaces while being maintained in intimate engagement therewith, and the carriage is capable of accurately moving longitudinally of the rail without moving toward and away from the rail surfaces at right angles thereto because such wobbling movements are precluded by the rail surfaces. However, technical difficulty is experienced in accurately maintaining the rollers in intimate with the rail surfaces. That is, care should be taken in accurately attaching the rollers to the carriage and in forming the rail surfaces on the rail. Moreover, these parts should be machined to a high degree of precision. This has made it impossible to replace the old carriage by a new one and the old carriage and the rail must be replaced as a unit by a new set of a carriage and rail. This is a drawback which causes inconvenience.

If the rollers press against the respective rail surfaces with a high force when the carriage is slidably mounted on the rail, the movement of the carriage along the rail will be obstructed and smooth movement of the carriage cannot be expected. If, on the other hand, the surfaces of the rollers are spaced apart, even if slightly, from the rail surfaces, the carriage will become wobbly when moving along the rail.

In assembling a drawing apparatus or a plotting machine of the rail type, after the carriage has been slidably mounted on the rail and adjustments have been effected such that the rollers are maintained in engagement with the respective rail surfaces with precision and accuracy, difficulty is experienced in effecting readjustments of the position of each of the rollers against the rail surfaces if the rollers are detached from the rail. Thus, in transporting a drawing apparatus or plotting machine of the rail type by disassembling it, it is necessary to pack the carriage and the rail as a unit without removing the carriage from the rail. This has the disadvantage of the package becoming too large to handle. Moreover, there is the trouble of providing carriage movement precluding means in order to prevent movement of the carriage along the rail during transportation.

In order to obviate the aforementioned disadvantages of the prior art, proposals have been made to use spring means for urging a roller by the biasing force thereof to move toward the respective rail surface by supporting the roller such that it can be moved toward or away from the rail surface. This arrangement has a disadvantage in that the rollers can be brought into engagement with the respective rail surfaces with precision and accuracy even if there is an error in the positions of the rollers relative to the rail. However, application of high pressure to any one of the rollers in a direction which is opposite to the direction in which it is moved by the biasing force of the spring means causes the roller to move in a wrong direction against the biasing force of the spring means. Thus, it becomes impossible for the carriage to move accurately along the longitudinal axis of the rail because it deviates therefrom in its movement. This disadvantage can best be obviated by providing means whereby the rollers can be made impervious to any force which would be exerted thereon and would tend to move the same in a direction opposite to the direction in which it is urged to move by the biasing force of the spring means. According to the invention, there is provided a device which make it possible to attain this end.

SUMMARY OF THE INVENTION

This invention has as its object the provision of a device for attaching rollers to a carriage adapted to move in sliding motion along a rail, in which the rollers rotatably supported by the carriage are maintained at their peripheries in engagement with rail surfaces parallel to each other and disposed longitudinally of the rail, and in which means is provided for precluding the movement of the rollers in a direction opposite to the direction in which they are urged to move by resilient means whereby the rollers rotatably supported by the carriage can be accurately and precisely maintained in engagement with the respective rail surfaces by a simple mechanism.

The outstanding features of the invention are that there are provided, in the carriage, presser means which is capable of moving in linear motion and which consists of members each formed therein with a gently inclined surface which is inclined with respect to the direction of movement of each member, support means for supporting the rollers for movement toward and away from the respective rail surfaces and consists of members each positioned against the gently inclined surface of one of the presser means, and resilient means adapted to urge the presser means by its biasing force to urge the gently inclined surfaces of the members of the presser means into pressing engagement with the members of the roller support means. By this arrangement, the rollers can be precisely and accurately maintained in pressing engagement with the respective rail surfaces, thereby enabling the carriage to move along the rail without becoming wobbly.

BRIEF DESCRIPTION OF THE DRAWINGS

FIG. 6 is a plan view of a lengthwise carriage;

FIG. 7 is a sectional view taken along the line 7—7 of FIG. 6;

DESCRIPTION OF EMBODIMENTS

Figure 1:
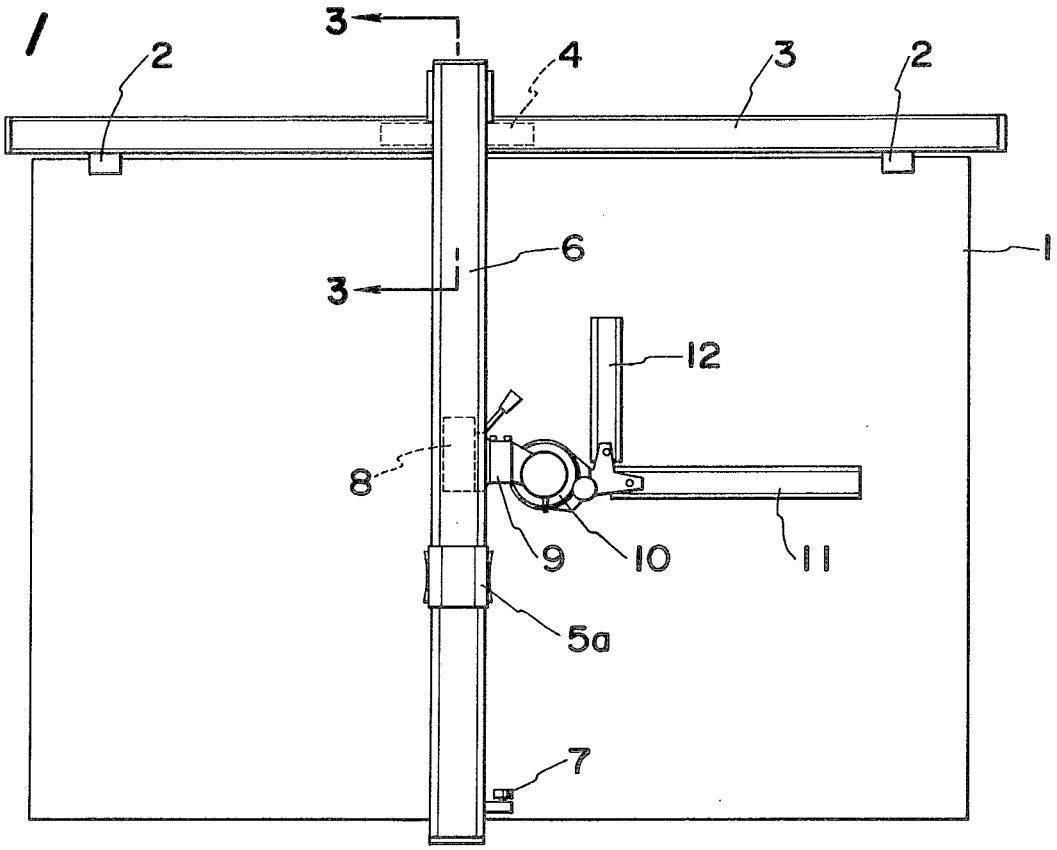
FIG. 1 is a plan view of a drawing apparatus of the rail type in its entirety in which the present invention can have application.

A drawing apparatus of the rail type in which this invention can have application will be outlined mainly with reference to FIG. 1. The apparatus comprises a drawing board 1 supported on a drawing table (not shown) and having mounted thereon through vices 2 a crosswise rail 3 on which a crosswise carriage 4 is slidably mounted. A lengthwise rail 6 is secured at one end thereof to an upper end of a mounting member 5 (See FIG. 3) which is in turn secured to the crosswise carriage 4. The lengthwise rail 6 supports for rotation at the other end thereof a tail portion roller 7 which rests on the drawing board 1.

Figure 8:
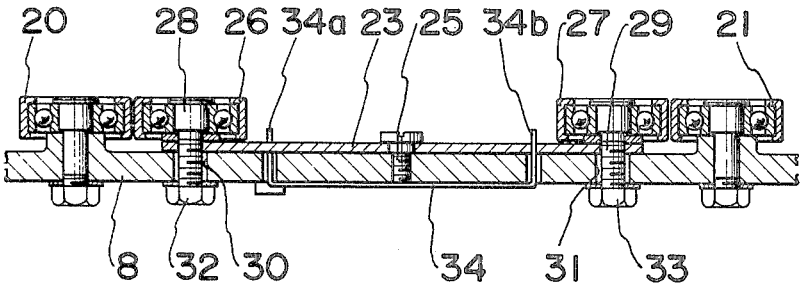
FIG. 8 is a sectional view taken along the line 8—8 of FIG. 6.

A lengthwise carriage 8 is slidably mounted on the lengthwise rail 6 and connected at one end thereof to a head 10 through a connecting member 9. The head 10 has rulers 11 and 12 connected thereto. The head 10 is provided with a handle If the handle is gripped by hand and a force directed parallel to the upper surface of the drawing board 1 is exerted on the head, the crosswise carriage 4 will move along the crosswise rail 3 and at the same time the lengthwise carriage 8 will move along the lengthwise rail 6, so that the rulers 11 and 12 connected to the head 10 will move in parallel motion to any position as desired on the drawing board 1. The construction of the lengthwise carriage 8 and lengthwise rail 6 will be described in detail with reference to FIG. 6, FIG. 7 and FIG. 8.

As shown, the lengthwise rail 6 has in its central portion vertical rails surfaces 13 and 14 and at opposite sides has horizontal rail surfaces 15 and 16. Both vertical and horizontal rail surfaces extend longitudinally of the lengthwise rail 6. Disposed on opposite sides of the lengthwise carriage 8 and rotatably supported by shafts are vertically disposed rollers 17, 18 and 19 which are positioned against the horizontal rail surfaces 15 and 16. Horizontally disposed rollers 20 and 21 positioned against the vertical rail surfaces 13 and 14 are arranged at the front and rear portions of the lengthwise carriage 8 and are rotatably supported on shafts. The horizontally disposed rollers 20 and 21 are eccentrically mounted and their centers deviate slightly to right and left with respect to a longitudinal center line 22 of the lengthwise carriage.

An arm 23 has formed in its central portion a slot 24 having its major axis extending at right angles to the direction of movement of the lengthwise carriage 8. The slot 24 receives therein a stem of a cap screw 25 secured to the lengthwise carriage 8, with the stem being slidable therein and being prevented from dislodging therefrom. Horizontally disposed rollers 26 and 27 are rotatably supported on shafts 28 and 29 respectively which are inserted through washers in openings formed at opposite end portions of the arm 23. The shafts 28 and 29 are loosely received at their lower end portions in openings or holes 30 and 31 which each have a diameter greater than that of the shafts 28 and 29. The aforementioned rollers are ball bearings each covered on the outer periphery with a layer of Teflon. Rollers subsequently to be described are of the same construction.

The shafts 28 and 29 each have thereon a threaded portion. The threaded portions of the shafts 28 and 29 have threaded thereon nuts 32 and 33 respectively which are disposed on the underside of the lengthwise carriage 8. A torsion bar 34 positioned on the bottom of the lengthwise carriage 8 has opposite end portions 34*a* and 34*b* which extend vertically through openings formed in the lengthwise carriage 8 and disposed above the upper surface of the lengthwise carriage 8. The upwardly extending portions 34*a* and 34*b* of the torsion bar 34 are resiliently positioned against opposite sides of the arm 23 near the opposite ends thereof. (See FIG. 6). The arm 23 is urged by the biasing force of the torsion bar 34 to move counter clockwise in FIG. 6 about the cap screw 25.

The lengthwise carriage 8 constructed as aforementioned is slidably mounted on the lengthwise rail 6 shown in FIG. 7. First of all, the nuts 32 and 33 are threadably onto the threaded portions of the shafts 28 and 29 and tightened in place while the horizontally disposed rollers 26 and 27 are arranged so that their centers are disposed on the longitudinal center line 22 of the lengthwise carriage 8 to thereby affix the shafts 28 and 29 to the lengthwise carriage. Then, the vertically disposed roller 17 is placed on the horizontal rail surface 15 and the vertically disposed rollers 18 and 19 are placed on the horizontal rail surface 16. The horizontally disposed rollers 20, 26, 29 and 21 are inserted between the vertical rail surfaces 13 and 14.

Thereafter, the nuts 32 and 33 threadably fitted over the shafts 28 and 29 are loosened. This allows the arm 23 to be moved in pivotal motion counter clockwise in FIG. 6 about the cap screw 25 by the biasing force of the torsion bar 34. As a result, the horizontally disposed roller 26 moves rightwardly in FIG. 6 into resilient pressing engagement with the vertical rail surface 14 and the horizontally disposed roller 27 moves leftwardly into resilient pressing engagement with the vertical rail surface 13. The biasing force of the torsion bar 34 which urges the horizontally disposed rollers 26 and 27 into resilient pressing engagement with the vertical rail surfaces 13 and 14 produces a reaction which brings the horizontally disposed rollers 20 and 21 into resilient pressing engagement with the vertical rail surfaces 13 and 14 respectively. Thus, all the horizontally disposed rollers 20, 21, 26 and 27 are accurately positioned against the vertical rail surfaces 13 and 14. If the nuts 32 and 33 are tightened on the threaded portions of the shafts 28 and 29 respectively to firmly fix the shafts 28 and 29 to the lengthwise carriage 8, the shafts 28 and 29 will not move even though the horizontally disposed rollers 26 and 27 are subjected to high pressure from the vertical rail surfaces 13 and 14.

The crosswise carriage 4 is provided with brake means the construction of which will be described with reference to FIG. 2 and FIG. 3. The crosswise carriage 4 has in its central portion braking rail surfaces 35 and 36 which extend in the longitudinal direction of the carriage 4 (See FIG. 3). An arm 37 is pivotally mounted in a suitable position in a substantially central portion thereof on a shaft 38 on the crosswise carriage 4 (see FIG. 2). The arm 37 has a brake shoe 39 attached to one side of one end portion thereof. Another arm 40 has at one end a projection to which another brake shoe 41 is affixed. The arms 37 and 40 are pivotally connected to each other at the other ends thereof by a shaft 42.

The arm 40 has on one side a upstanding portion 43 in which are threaded holes into which the ends of threaded rods 45 and 46 are threaded. A plate 44 having holes therein through which rods 45 and 46 extend freely is movable up and down on rods 45 and 46. A coil spring 47 is mounted between the upstanding portion 43 and the plate 44 and disposed between the threaded rods 45 and 46. A pivotal lever (See FIG. 3) 48 is pivotally connected at its intermediate portion by a shaft 9 to a side wall of the mounting member 5. The pivotal lever 48 has at one side of its lower end portion a projection which has positioned against the plate 44. The pivotal lever 48 is formed at its upper end a bifurcation which receives therein a shaft 51 connected to one end of a movable rod 50 which is connected at the other end thereof to a cover 5a (See FIG. 1) movably fitted over the lengthwise rail 6. The brake shoes 39 and 41 are juxtaposed against the braking rail surfaces 35 and 36 respectively of the crosswise rail 3.

Figure 2:
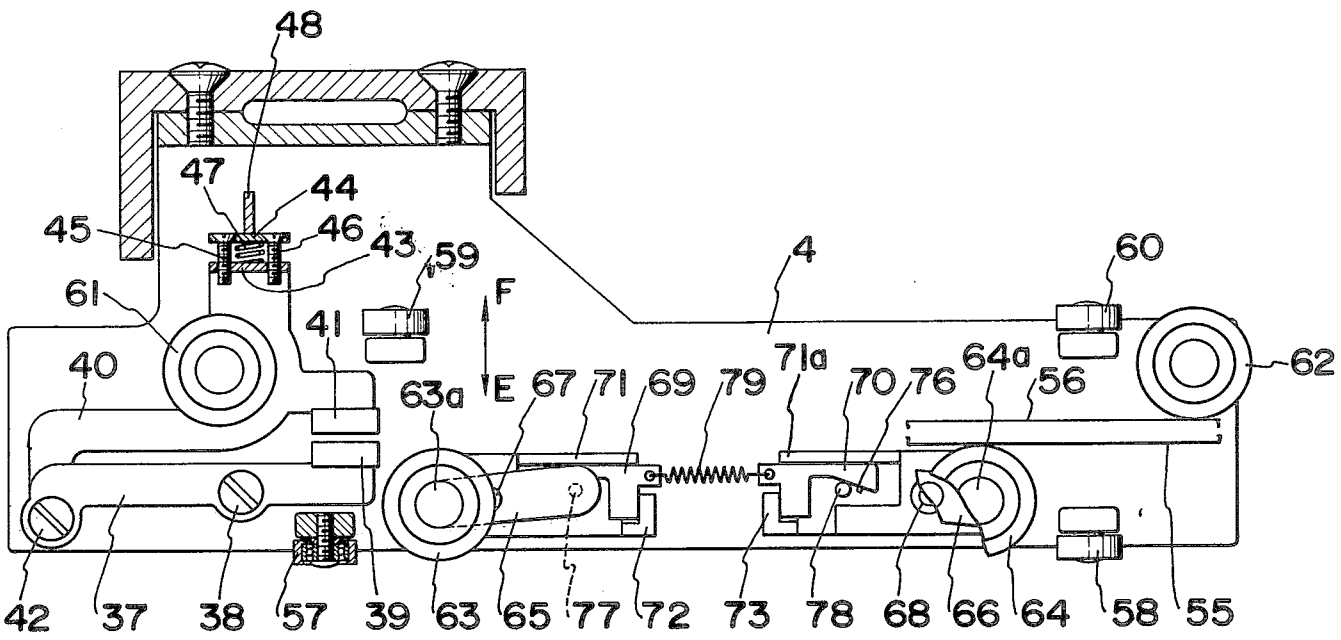
FIG. 2 is a plan view of a crosswise carriage, with certain parts thereof being cut out.
Figure 3:
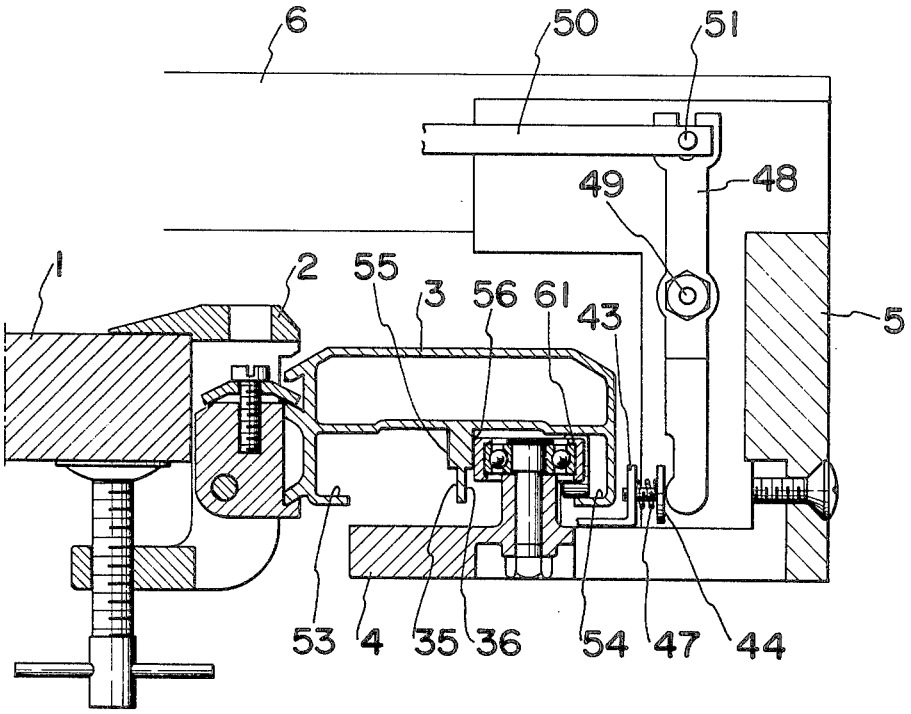
FIG. 3 is a sectional view taken along the line 3—3 of FIG. 1.
Figure 4:
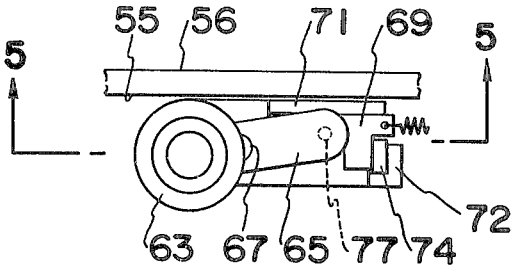
FIG. 4 is a plan view showing the device for attaching rollers.
Figure 5:
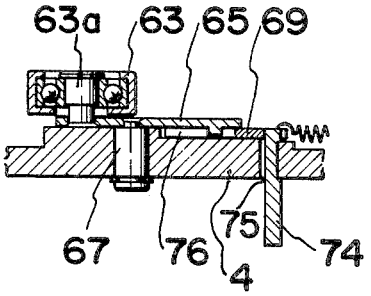
FIG. 5 is a sectional view taken along the line 5—5 of FIG. 4.

Upon the cover 5a being moved a predetermined distance along the lengthwise rail 6 to thereby move the movable rod 50 rightwardly in FIG. 3, the pivotal lever 48 moves in pivotal motion about the shaft 49 and its lower end moves leftwardly in FIG. 3, so that the projection pushes the plate leftwardly. Leftward movement of the plate 44 causes the arm to be moved in the direction of an arrow E in FIG. 2 about the shaft 42 by the biasing force of the coil spring 47. This brings the brake shoe 41 into pressing engagement with the braking rail surface 36. The biasing force of the coil spring 47 is transmitted to the arm 37 substantially at the same time as the arm 40 moves in pivotal motion, so that the arm 37 moves in pivotal motion counter clockwise in FIG. 2 about the shaft 38 to thereby bring the brake shoe 39 into pressing engagement with the braking rail surface 35. Thus, the crosswise carriage 4 is fixed in place on the crosswise rail 3.

If the distance between the braking rail surfaces 35 and 36 are too great or the amount of movement of the movable rod 50 is too great, the plate 44 will move further leftwardly in FIG. 3 after the brake shoes 39 and 41 are brought into pressing engagement with the braking rail surfaces 35 and 36 along the threaded rods 45 and 46 in sliding motion, the rods passing through the openings formed in the plate 44, against the biasing force of the coil spring 47. Thus, the movement of the plate 44 will not be interrupted and no excessively large force will be exerted on the braking rail surfaces 35 and 36. By this arrangement, no appreciable influences are exerted on the accuracy with which the brake can be applied to the crosswise carriage 4 by the lack of precision with which the brake shoes 39 and 41 are positioned with respect to the braking rail surfaces, if the error is not too great.

The construction of the crosswise rail 3 and the crosswise carriage 4 will now be described in detail with reference to FIG. 2 to FIG. 5. The crosswise rail 3 has at its opposite sides horizontal rail surfaces 53 and 54 which extend longitudinally of the crosswise rail 3 and disposed parallel to the surface of the drawing board 1. The crosswise rail 3 has in its central portion vertical rail surfaces 55 and 56 which extend longitudinally of the crosswise rail 3 and disposed perpendicularly to the surface of the drawing board 1. The crosswise carriage 4 has rotatably attached thereto and disposed in positions corresponding to the horizontal rail surfaces 53 and 54 of the crosswise rail 3 vertically disposed rollers 57, 58 and 59, 60 respectively which can rotate on the respective rail surfaces.

Horizontally disposed rollers 63 and 64 attached to the crosswise carriage 4 in positions corresponding to the vertical rail surface 55 (FIG. 3) are supported by shafts 63*a* and 64*a* secured to one end of pivotal arms 65 and 66 respectively which constitute roller support means (See FIG. 2). The pivotal arms 65 and 66 are secured at their intermediate portions to shafts 67 and 68 respectively which are rotatably received in openings formed in the crosswise carriage 4. Presser means comprises members 69 and 70 positioned at one side thereof against guide members guides 71 and 71*a* respectively which are secured to the crosswise carriage 4. The members 69 and 70 of the presser means are capable of moving in sliding motion along the guides 71 and 71*a* respectively in a direction which is parallel to the direction of movement of the crosswise carriage 4.

The members 69 and 70 of the presser means are urged to move toward each other by the biasing force of a coil spring 79 constituting resilient means.

Stops 72 and 73 project upwardly from the upper surface of the crosswise carriage 4 and are disposed in the path of movement of the members 69 and 70 of the presser means. Formed in the crosswise carriage 4 and disposed adjacent the surfaces of the stops 72 and 73 are openings 75 which each receive therein blocking means in the form of a wedge member 74. The members 69 and 70 of the presser means each have a gently inclined surface 76 which is inclined gently with respect to the direction of movement of the presser members 69 and 70. Shafts 77 and 78 secured at one end to the pivotal arms 65 and 66 are positioned at the other end against the inclined surfaces 76 of the presser members 69 and 70, the arms 65 and 66 and the shafts 77 and 78 together constituting abutment means.

In the aforementioned construction, the members 69 and 70 of the presser means are moved by both hands in opposite directions against the biasing force of the coil spring 79, and the wedge members 74 are inserted in the respective openings 75 disposed adjacent the stops 72 and 73 respectively. When the hands are released from the passer members 69 and 70, the members 69 and 70 will move together each other by virtue of the biasing force of the coil spring 79 and their end surfaces will be brought into abutting engagement with the respective wedge members 74 so that they are locked in position (See FIG. 4 and FIG. 5).

Then, vertically disposed rollers 57, 58 and 59, 60 are placed on the horizontal rail surfaces 53 and 54 of the crosswise rail 3, and the horizontally disposed rollers 63, 64 and 61, 62 are arranged to be positioned against the vertical rail surfaces 55 and 56 thereof respectively. Upon removing the wedge members 74 from the respective openings 75, the presser members 69 and 70 further move toward each other by virtue of the biasing force of the coil spring 79, so that the shafts 67 and 68 secured to one of the pivotal arms 65 and 66 respectively are moved by the respective inclined surfaces 76 of the presser members 69 and 70 away from the vertical rail surface 55. This causes the pivotal arm 65 to move in pivotal motion clockwise in FIG. 2 about the shaft 67 and causes the pivotal arm 66 to move in pivotal motion counter clockwise in the same figure about the shaft 68, so that the peripheries of the horizontally disposed rollers 63 and 64 are brought into resilient pressing engagement with the vertical rail surface 55 of the crosswise rail 3. The resilient pressing engagement of the horizontally disposed rollers 63 and 64 produces a reaction which brings the peripheries of the horizontally disposed rollers 61 and 62 into resilient pressing engagement with the vertical rail surface 56 of the crosswise rail 3.

If the crosswise carriage 4 is subjected to high pressure which is oriented in other directions than the direction of movement of the crosswise carriage 4, the horizontally disposed rollers 63 and 64 will be pressed against the vertical rail surface 55 with a high force and a high reaction will act on the horizontally disposed rollers 63 and 64. If this is the case, the reaction will cause the shafts 77 and 78 to press against the gently inclined surfaces 76 of the presser members 69 and 70 respectively. However, since the direction in which the shafts 77 and 78 press against the inclined surfaces 76 are at right angles to the direction of movement of the presser members 69 and 70, the presser members 69 and 70 are kept from moving even if high pressure is applied thereto by the shafts 77 and 78 respectively. Accordingly, even if high pressure oriented in the direction of an arrow F in FIG. 2 is applied to the horizontally disposed rollers 63 and 64, a reaction identical in magnitude to this pressure and oriented in the opposite direction is applied by the gently inclined surfaces 76 of the presser members 69 and 70 to the shafts 78 and 79, so that the horizontally disposed rollers 63 and 64 are prevented from moving in the direction of the arrow F. By this arrangement, all the horizontally disposed rollers of the crosswise carriage 4 are maintained in intimate contact with the vertical rail surfaces of the crosswise rail 3 without pressing against them with too high a force or without moving away therefrom. Thus the crosswise carriage 4 is maintained in engagement with the crosswise rail 3 and can move therealong without becoming wobbly. By using the device for attaching rollers to a carriage according to the invention, a high degree or precision is not required in positioning the vertical rail surfaces 55 and 56 of the crosswise rail 3 and in attaching the rollers to the crosswise carriage 4. Even if there are errors in designing or working on the carriage and rail, they have no adverse effect on the operation of the carriage. Moreover, the crosswise carriage 4 can be fitted on the crosswise rail 3 with ease.

Another embodiment of the invention will be described with reference to FIG. 9 and FIG. 10. A crosswise rail 82 is secured to a drawing board 81 and includes vertical portions 82*a* and 82*b* which have in their inner surfaces grooves 83 and 83*a* respectively extending longitudinally of the rail 82. Rollers 85, 86 and 87, 88 rotatably supported by a crosswise carriage 84 are rotatably fitted in the grooves 83*a* and 83 respectively. The crosswise carriage 84 is slidably fitted on the crosswise rail 83 and includes a rise portion 84*a* which supports, by a shaft, a lengthwise rail 89 for vertical pivotal movement with respect to the surface of the drawing board 81. Tail end rollers (not shown) positioned against the drawing board 81 are rotatably supported on shafts at an open end of the lengthwise rail 89.

The rollers 85 and 86 are rotatably supported on shafts 98 and 99 respectively which are secured to the carriage 84. The rollers 87 and 88 are rotatably supported on shafts 104 and 105 respectively which are secured to the substantially central portions of pivotal arms 102 and 103 which in turn are pivotally connected at one end thereof by shafts 100 and 101 respectively to the carriage 84. Members 106 and 107 constituting presser means are supported for sliding movement on the upper surface of the crosswise rail 82 and disposed longitudinally thereof while guided by guide members in the form of guides 108, 109 and 110, 111 respectively. The presser members 106 and 107 are urged by the biasing forces of springs 112 and 113 to move toward opposite ends of the crosswise carriage 84. The presser members 106 and 107 have thereon inclined surfaces 114 and 115 which are maintained in resilient engagement with abutment means in the form of the free ends of the pivotal arms 102 and 103 respectively. By this arrangement, the pivotal arm 102 are normally urged to move counter clockwise in pivotal motion about the shaft 104 while the pivotal arm 103 is normally urged to move clockwise in pivotal motion about the shaft 109 in FIG. 9. The rollers 87, 88 are maintained in resilient engagement with the groove 83 by the biasing forces of the springs 112 and 113 acting on the pivotal arms 102 and 103.

Figure 9:
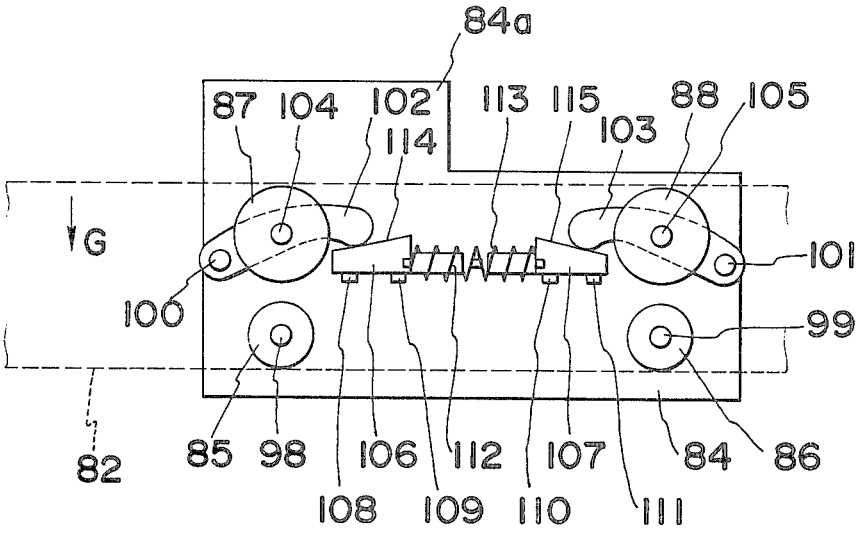
FIG. 9 is a diagrammatic plan view for explanation of another embodiment of the device for attaching the rollers.
Figure 10:
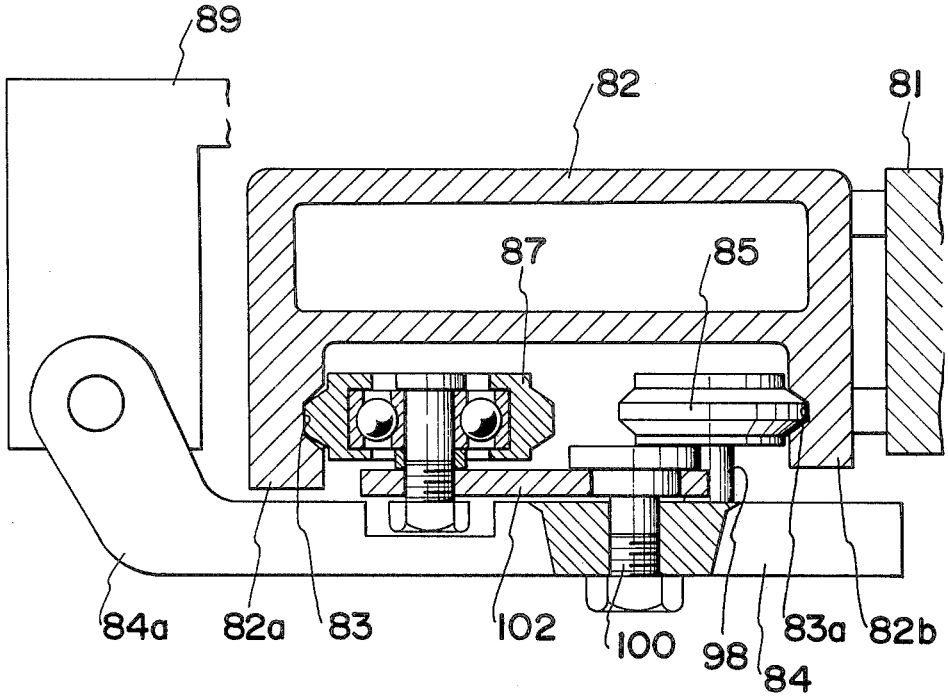
FIG. 10 is a sectional view for explanation of the embodiment shown in FIG. 9.

In the aforementioned construction, the presser members 106 and 107 are moved toward each other or toward the center portion of the crosswise carriage 84 along the guides 108, 109 and 110, 111 against the biasing forces of the springs 112 and 113 respectively, and the rollers 87 and 88 are moved toward longitudinal center line of the carriage 84 in FIG. 9. Then, the transverse carriage 84 is placed under the crosswise rail 82, and the rollers 85, 86 and 87, 88 are inserted between the vertical portions 82*a* and 82*b* of the carriage 82. After this, the presser members 106 and 107 are released. As a result, the presser members 106 and 107 move along the guides 108, 109 and 110, 111 respectively and push free ends of the pivotal arms 102 and 103 by the respective inclined surfaces 114 and 115. This causes the pivotal arms 102 and 103 to move in pivotal motion and brings the outer peripheries of the rollers 87 and 88 into resilient engagement with the groove 83. If the rollers 87 and 88 are brought into resilient engagement in the groove 83, the rollers 85 and 86 will also be brought into resilient engagement in the groove 83.

Pressure applied to the rollers 87 and 88 in the direction of an arrow G in FIG. 9 from the groove 83 is absorbed by the gently inclined surfaces 114 and 115 of the presser members. Thus, application of pressure oriented in the direction of the arrow G to the rollers 87 and 88 causes no pivotal movement of the pivotal arms 102 and 103 about the shafts 100 and 101 respectively, so that movement of the rollers 87 and 88 in the direction of the arrow G can be precluded.

Figure 11:
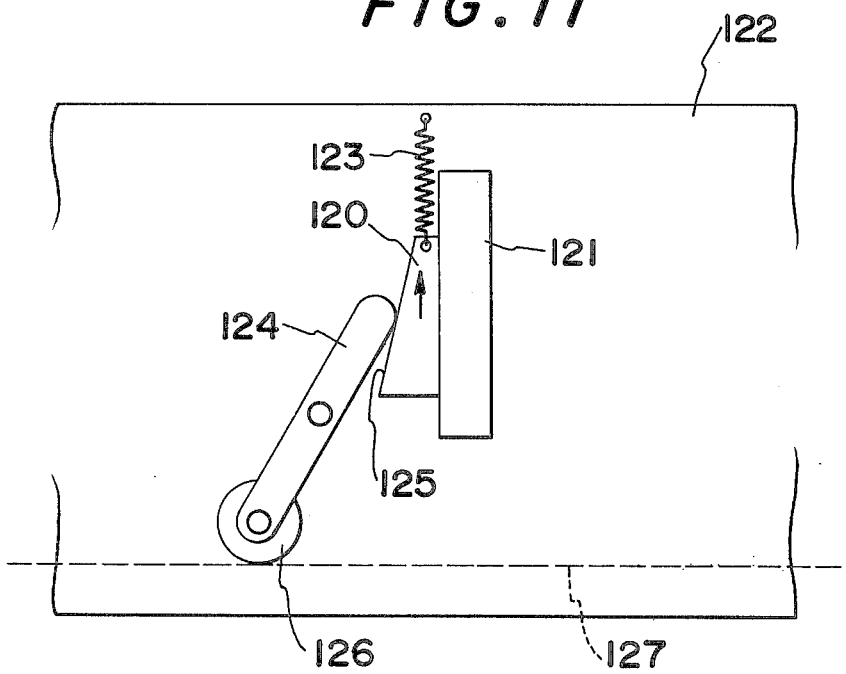
FIG. 11 is a diagrammatic plan view for explanation of another embodiment of the device for attaching the rollers.

In the embodiments shown and described hereinabove, the presser means have been described as being mounted for movement in a direction parallel to the direction of movement of the carriage. It is to be understood, however, that the invention is not limited to this specific arrangement of the presser means. As shown in FIG. 11, a presser member 120 may be adapted to move by a guide 121 in a direction which is at right angles to the direction of movement of a carriage 122. The presser member 120 is urged to move in the direction of an arrow by the biasing force of a spring 123. A pivotal arm 124 supported at its intermediate portion for pivotal movement on a shaft on the carriage 122 has one end which is positioned against an inclined surface 125 of the presser member 120, and rotatably supports at the other end a roller 126 which is resiliently maintained at its outer periphery against a rail surface 127. By this arrangement, the roller 126 is automatically maintained in resilient engagement with the rail surface, and even if pressure oriented in the direction of the arrow is applied to the roller 126, the presser member 120 is kept from moving in a direction opposite to the direction of movement of the arrow. Thus, the roller 126 is prevented from being moved by pressure oriented in the direction of the arrow.

I claim:

1. In a drawing apparatus, the combination of:

a rail having a plurality of rail surfaces extending longitudinally thereof;

a carriage slidably mounted on said rail for movement therealong;

first rollers rotatably mounted on said carriage and positioned against one of the rail surfaces of said rail;

at least one guide member on said carriage;

presser means including at least one member engaged with said guide member on said carriage for linear movement along said guide member and having thereon a surface gently inclined with respect to the direction of said linear movement;

abutment means positioned in the path of movement of said inclined surface on said one member of said presser means and engaged by said inclined surface during said linear movement;

mounting means on which said abutment means is mounted for movement of said abutment means towards and away from another to said rail surfaces;

at least one further roller mounted on said abutment means;

resilient means engaged with said one member of said pressure means for moving said one member toward said abutment means; and blocking means movably mounted on said carriage for movement into and out of the path of movement of said one member of said presser means at a position to block movement of said one member toward said abutment means at a position where said further roller is out of contact with said another of said rail surfaces.

2. The combination as claimed in claim 1 in which said abutment means comprises roller support means for said further roller on which said further roller is rotatably mounted, said roller support means being mounted on said carriage for movement of said further roller toward and away from a rail surface, and a shaft on said roller support means projecting into the path of the inclined surface which is on said one member of said presser means.

3. The combination as claimed in claim 1 in which there are at least two of said further rollers and two of said roller support means, said further rollers and roller support means being mounted on one side of said carriage, and there are two said members engaged with said guide members on said carriage for movement parallel to the direction of movement of said carriage.

* * * * *